United States Patent [19]

Johnson et al.

[11] 4,004,516

[45] Jan. 25, 1977

[54] FUZE

[75] Inventors: Clifford T. Johnson; Melvin J. McCubbin; Thomas R. Zulkoski, all of Ridgecrest, Calif.

[73] Assignee: The United States of America as represented by the Secretary of the Navy, Washington, D.C.

[22] Filed: Oct. 24, 1975

[21] Appl. No.: 625,449

[52] U.S. Cl. ..... 102/24 R; 102/56 R; 102/70 R

[51] Int. Cl.[2] ..... F42B 1/00

[58] Field of Search ..... 102/24 R, 70 R, 56, 102/1 R, 2

[56] References Cited

UNITED STATES PATENTS

| | | | |
|---|---|---|---|
| 1,556,027 | 10/1925 | Ragsdale | 102/2 |
| 2,828,691 | 4/1958 | Webster | 102/70 R |
| 3,173,364 | 3/1965 | Nordzell | 102/56 X |
| 3,401,632 | 9/1968 | Griffith et al. | 102/24 R |
| 3,665,857 | 5/1972 | Radnich et al. | 102/56 X |
| 3,713,359 | 1/1973 | Andrew | 102/24 R X |
| 3,713,360 | 1/1973 | Shansey | 102/24 R X |
| 3,749,024 | 7/1973 | Pakulak | 102/56 X |

*Primary Examiner*—David H. Brown
*Attorney, Agent, or Firm*—R. S. Sciascia; Roy Miller; Gerald F. Baker

[57] ABSTRACT

An existing booster and fuze combination is modified to provide relief from temperature and pressure buildup in an open fire environment. The booster explosive, thus, is encased in a low temperature melting plastic and the main housing is vented by boring a number of passages through the major thread diameter shoulder of the fuze case.

2 Claims, 2 Drawing Figures

FUZE

BACKGROUND OF THE INVENTION

Whenever ordinance is involved in a fire, the potential damage to persons and property involved is increased. In an effort to minimize the possibility of the explosive damage under such circumstances, methods and materials have been suggested to insure that any warheads present are so constructed that involvement in a fire will not result in a high order explosion. Thus, high explosive materials for warheads have been specified which will melt or burn or otherwise be harmlessly dissipated in an open fire environment.

In general, the problem of providing warheads which will survive the open fire environment has been successfully accomplished. However, when the warhead has been armed with the insertion of the fuze and booster or detonating material, the possibility of the booster or detonating material initiating a high order explosion is greatly increased. In some ordinance, the fuze and booster can be placed at the last minute before firing or before loading on an aircraft but, when the warhead is encased in a missile housing it is impractical to delay final assembly until the missile is to be used.

SUMMARY

Efforts have been directed, therefore, to producing an all up round which would survive an open fire environment without violent explosion.

According to the present invention the fuze and booster container have been modified by manufacturing the booster cup from a material that will soften and melt before the self-detonation temperature of the booster and a plurality of vent holes have been provided to prevent pressure buildup.

DESCRIPTION AND OPERATION

Figure 1:
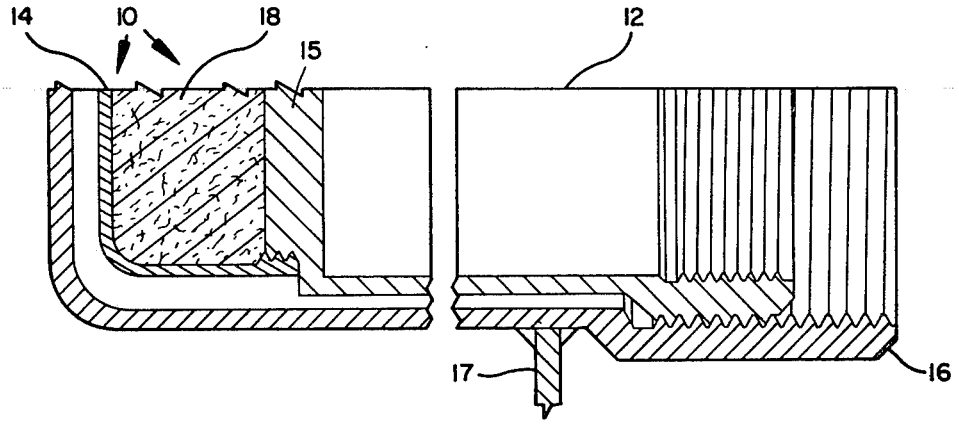
Fig. 1 (Prior Art)
FIG. 1 is a partial longitudinal cross sectional view of a prior art booster and fuze housing.

As shown in FIG. 1 a fuze container 12 having a booster cup 14 mounted thereon is threadedly contained in a housing 16 integrally fastened into a rear bulkhead 17, for example, of a missile warhead casing. The cup 14 which is fastened to a lesser diameter threaded end portion 15 of container 12, has been generally manufactured of a metal such as tin or aluminum and contains the booster material 18. The booster material 18 is explosive and is designed to be set off by a fuze mechanism (not shown) which threads into the fuze housing 12.

Figure 2:
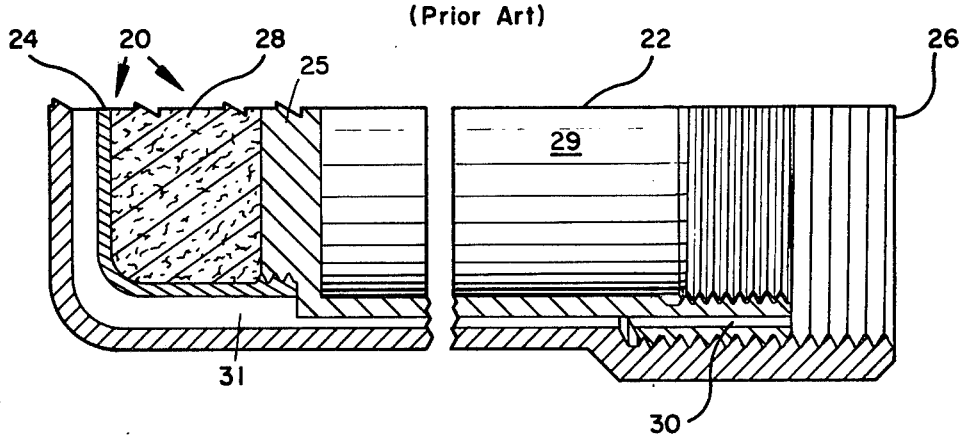
FIG. 2 is a view similar to FIG. 1 of a booster and fuze housing modified according to the present invention.

According to the present invention, the booster and fuze arrangement generally designated at 20 in FIG. 2 is constructed in much the same manner as the arrangement 10 in FIG. 1. However, in FIG. 2, the fuze 29 is shown in place and the fuze and booster container 22 has a number of passageways 30 bored in the major thread diameter shoulder. This relieves the temperature and pressure buildup in the expansion space or chamber 31 between the housing 26 and the fuze-booster casing 22. In addition, the confinement of the booster material 28 is lessened by manufacturing the booster cup 24 of plastic material which will soften and melt before the self-detonation temperature of the booster explosive material. The booster cup 24 is fastened to a lesser diameter threaded end portion 25 as in the prior art.

Thus, the booster-fuze modification according to the present invention lessens the probability of undesirable violent reactions by providing relief from booster explosive temperature and pressure buildup within the warhead area.

Any material that will soften and melt before the self-detonation temperature of the booster may be used in the manufacture of the cup 24 and the number of holes 30 necessary to vent the space between the container 22 and housing 26 may be determined impirically.

Although the invention has been exemplified by a specific embodiment having holes bored through shoulder of container 22, it is contemplated that venting may be accomplished in any convenient manner as by slotted threads or holes in housing 16 behind the bulkhead 17.

What is claimed is:

1. In a booster-fuze combination wherein a booster and fuze are fastened together as a unit and inserted in a housing contained within a warhead, the improvement comprising:

said fuze being contained within a metal container having a threaded shoulder for attachment within a threaded housing and a lesser diameter threaded end portion receiving a booster cup;

an explosive booster material in said cup having a predetermined self-detonation temperature;

said booster cup being manufactured of a material which will soften and melt before the self-detonation temperature of the booster; and a plurality of through holes bored longitudinally through said fuze container shoulder.

2. In a booster-fuze combination wherein a booster and fuze are fastened together as a unit and inserted in a housing fastened within the rear bulkhead of a warhead, the improvement comprising:

said fuze being contained within a metal container having a threaded end portion receiving a booster cup;

an explosive booster material in said cup having a predetermined self-detonation temperature;

said booster cup being manufactured of a material which will soften and melt before the self-detonation temperature of the booster;

said booster cup being spaced from said metal container to provide an expansion chamber; and venting means rearward of said bulkhead.

* * * * *